United States Patent [19]

Binstock

[11] 4,019,467

[45] Apr. 26, 1977

[54] VALVE SEQUENCING STARTUP CONTROL SYSTEM FOR ONCE-THROUGH BOILER

[75] Inventor: Morton H. Binstock, Pittsburgh, Pa.

[73] Assignee: Westinghouse Electric Corporation, Pittsburgh, Pa.

[22] Filed: Apr. 20, 1976

[21] Appl. No.: 678,526

[52] U.S. Cl. ..... 122/406 ST; 60/646; 60/667

[51] Int. Cl.[2] ..... F22B 29/12

[58] Field of Search ..... 122/406 S, 406 ST, 448 S, 122/451 S; 60/646, 667

[56] References Cited

UNITED STATES PATENTS

| | | | |
|---|---|---|---|
| 3,262,431 | 7/1966 | Hanzalek | 122/406 |
| 3,286,466 | 11/1966 | Stevens | 122/406 |
| 3,366,093 | 1/1968 | Stevens et al. | 122/406 |
| 3,789,806 | 2/1954 | Gorzegno | 122/406 |
| 3,954,087 | 5/1976 | Stevens et al. | 122/406 |

*Primary Examiner*—Kenneth W. Sprague
*Attorney, Agent, or Firm*—E. F. Possessky

[57] ABSTRACT

A once-through boiler is provided with integral separators and a plurality of valves for controlling fluid flow during boiler startup. A pressure control generates an open or close signal for all of the valves and a sequence selector responds to the pressure control and a valve-in-operation logic circuit to generate valve selection signals which enable the valves to respond sequentially to the pressure control output.

10 Claims, 7 Drawing Figures

VALVE SEQUENCING STARTUP CONTROL SYSTEM FOR ONCE-THROUGH BOILER

CROSS-REFERENCE TO RELATED APPLICATIONS

Application Ser. No. 678,525 entitled "Improved Flow Control For once-Through Boiler Having Integral Separators", assigned to the present assignee and filed by the present inventor on Apr. 20, 1976.

BACKGROUND OF THE INVENTION

The present invention relates to electric power plants and more particularly to startup control systems for once-through boilers having integral separators.

It has been common to employ an off-stream flash tank for startup of a once-through boiler. For example, the boiler may be designed to provide 246.05 KGSC (kilograms per square centimeter) steam at the turbine during normal operation and the flash tank may be designed to supply steam at 70.3 KGSC for startup and operation of the turbine up to about 10% load. During all startups, a V valve between the primary and secondary superheater is closed, and P and N valves are open. Water is heated in furnace section and primary superheater passes and flows into the flash tank where the steam is separated from the water. The steam then flows back to the final superheater where additional heat is added before flowing to the turbine. The steam generated in this manner requires coordinated action to open the V valve, close a P valve, and modulate the burner firing rate and adjust the turbine valves to avoid interaction which could cause abrupt changes in steam temperature or pressure or turbine/generator output. Operation with this type system has been satisfactory for base loaded units, but the complex startup and shutdown procedure has made it unsuitable for cycling service.

More recently, an integral separator starting system has been developed for Foster-Wheeler once-through boilers, and it decreases the complexity of starting and increases the availability and cycling capacity of the once-through boiler. In this arrangement, the low pressure off-line flash tank is eliminated and a set of separators are installed in the main flow path upstream from the primary superheater. In this manner, provision is made for: (1) water to flow through the furnace tubes at a minimum rate to protect them from overheating; (2) diversion of water from passage to the turbine; and (3) a startup supply of steam until the boiler reaches its normal operating range.

In the integral separator startup system, a plurality of sets of valves are disposed upstream from the separators to control the waterwall pressure or the back pressure on the boiler feed pump as the boiler is ramped into operation. A set of W valves and a parallel set of Y valves have been coordinatively operated in the Foster-Wheeler boiler to control waterwall pressure as the boiler moves up to 25% load. Above 25% load, the W and Y valves are open.

An additional set of PPR valves have more recently been added in parallel to the W and Y valves to provide finer waterwall pressure control over a lower pressure operating range. For example, the PPR valves may provide pressure control up to 246.05 KGSC, and the W and Y valves may provide pressure control from 249.57 KGSC up to about 337.44 KGSC at 25% load.

Since the number of PPR valves may vary from plant to plant, it is desirable that a control designed to operate valves like the PPR valves be flexible for manufacturing variability while reliably providing the basic sequencing functions needed for pressure control.

SUMMARY OF THE INVENTION

A system is provided for operating pressure regulating valves in a once-through boiler having integral separator means. A pressure control generates a signal which actuates a sequencer means if no valve is operating and further actuates a valve drive for the pressure regulating valve corresponding to the valve select signal generated by the sequencer means. The system is readily modified for operating different numbers of valves in different applications.

DESCRIPTION OF THE PREFERRED EMBODIMENT

POWER PLANT

Figure 1:
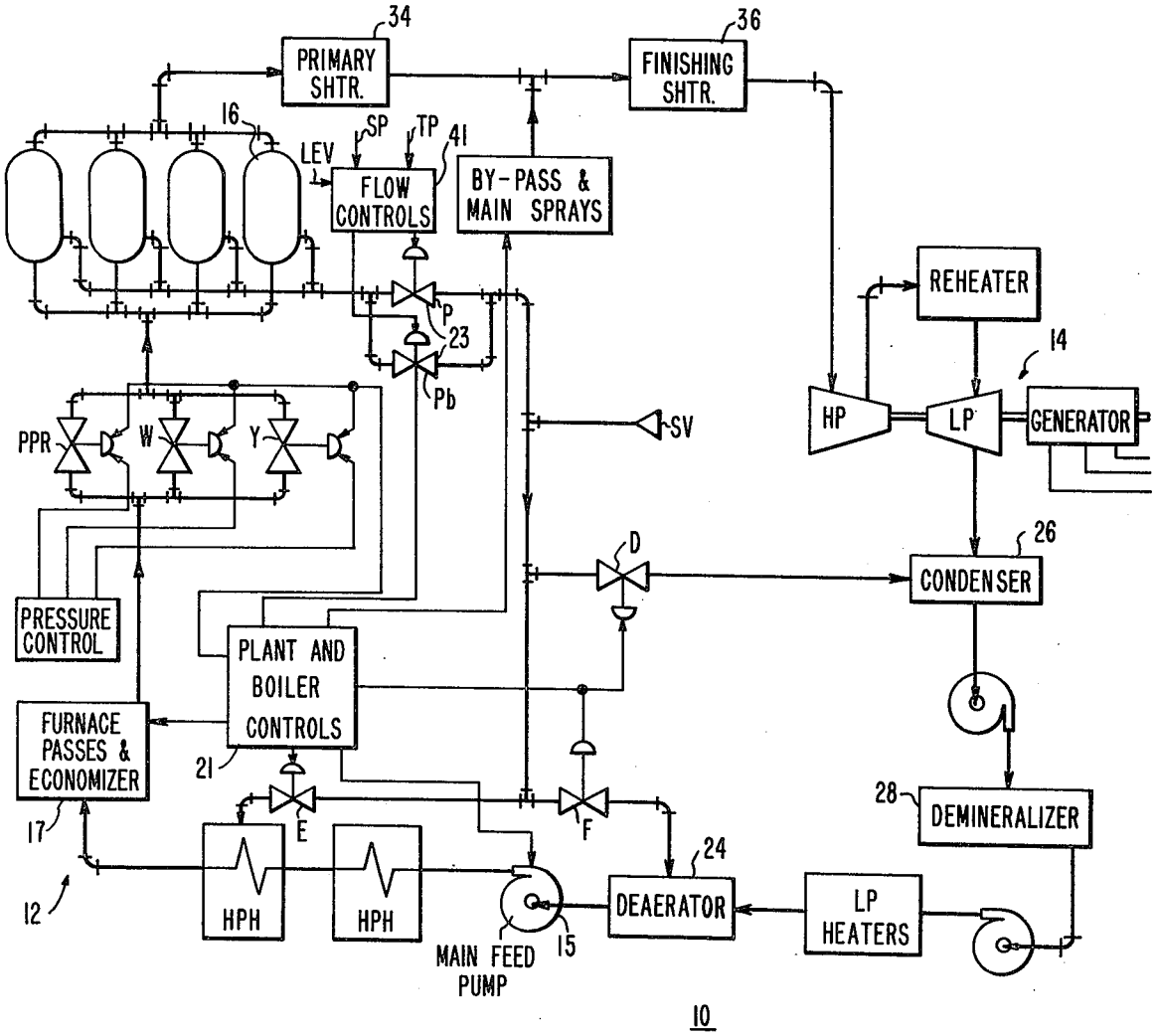
FIG. 1 shows a block diagram of an electric power plant in which the invention is implemented.

More particularly, there is shown in FIG. 1 a schematic diagram of an electric power plant 10 in which a once-through boiler 12 is started to generate steam for driving a turbine-generator 14 in accordance with the principles of the invention. The boiler 12 is an integral separator startup type made by Foster-Wheeler Corporation.

The boiler includes a plurality of separator units 16, in this case 32 units, connected in parallel in the outlet flow path from a furnace 17 which heats the fluid under burner control. A boiler feed pump 15 drives the fluid through the system. During startup, the working fluid is separated into turbine steam and return water flow until the operating level of the furnace reaches the point where the outlet fluid reaches supercritical pressure and temperature, at which time essentially no water exists for separation.

Figure 2A:
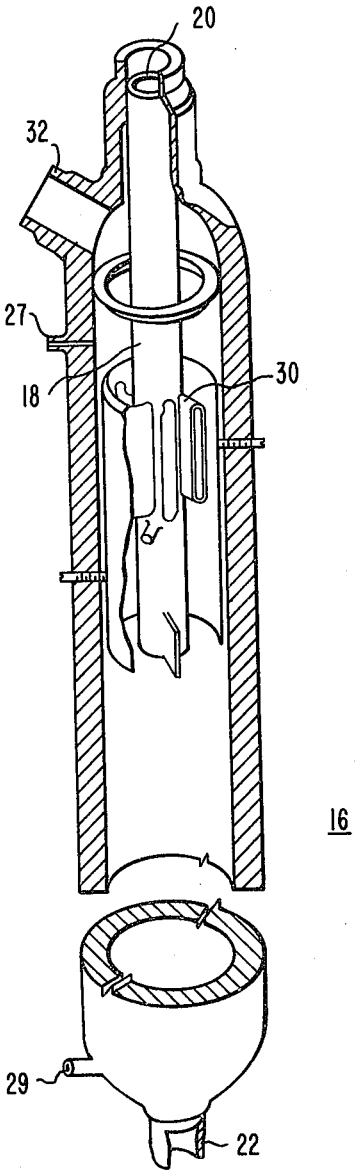
FIG. 2A shows a cutaway view of a separator used in the once-through boiler employed in the plant.
Figure 2B:
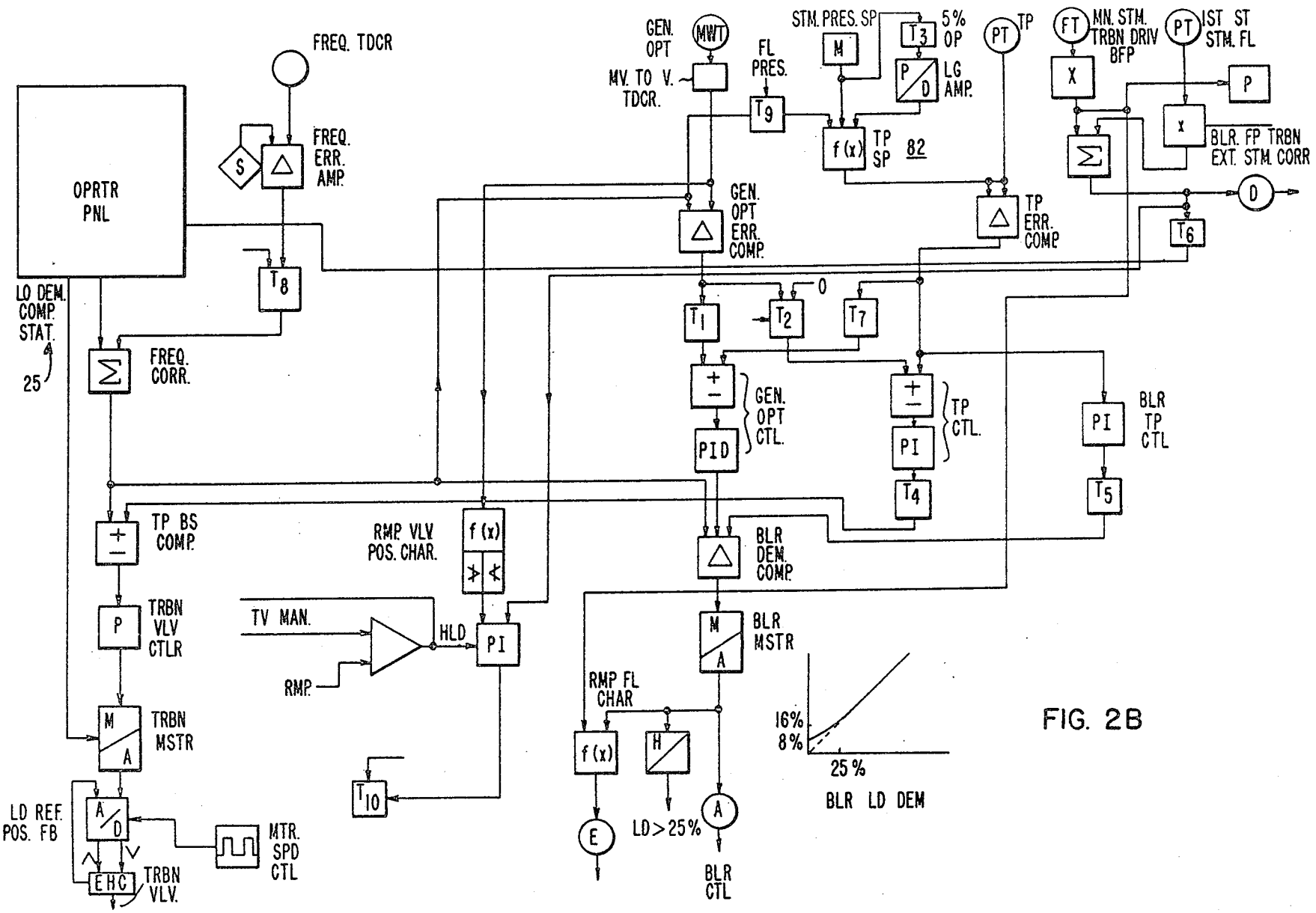
FIG. 2B shows a schematic diagram of a plant control at the highest hierarchical level of a control system for the plant.

Each separator unit 16 (FIG. 2) includes a central tube 18 into which fluid flows through an inlet 20. Water outflow from the tube 18 passes through an outlet 22 to separator level and pressure controlled drain valves 23 (FIG. 1) for return to a deaerator 24. Steam in the drain flow returns through a condenser 26 and demineralizer 28. Detector tubes 27 and 29 provide coupling connections between a level detector and the separator.

In the tube 18, fluid passes to spiral arms 30 where water and steam are separated by centrifugal action. The steam rises for outflow through a top nozzle 32 to a primary suerheater 34 and a final superheater 36 and the water flows to the drain outlet 22. When the fluid reaches a supercritical state, there is no water and the drain valves 23 are closed to cause all entering fluid to pass through the nozzle 32.

Figure 3:
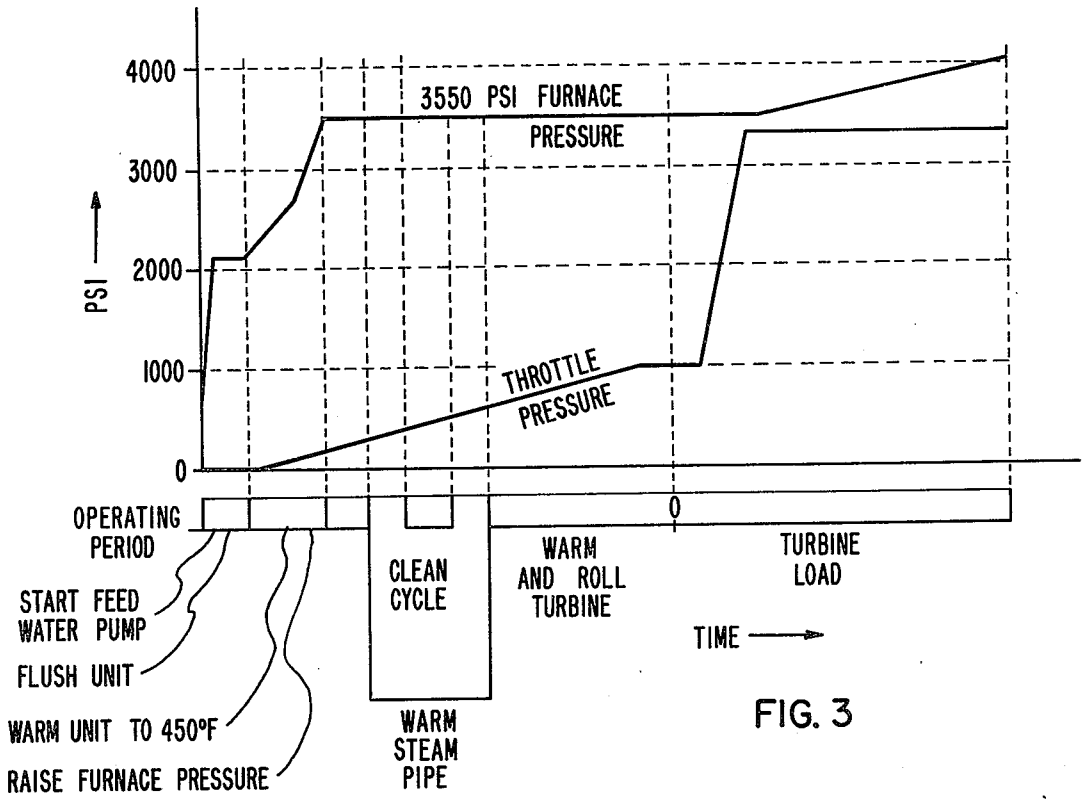
FIG. 3 illustrates the pressure operation of the plant.

As illustrated in FIG. 3, a full startup cycle of the plant comprises:

1. cold water flushing — to clean the puping;
2. warmup of the water and initial operation, to approximately 70.3 KGSC and 7% load — steam for the turbine at this time is supplied by the steam separator;
3. pressure ramp — the transition zone from 70.3 KGSC pressure at 7% load with steam being supplied by the separator to 246.05 KGSC supercritical once-through operation at 25% load; and
4. full pressure operation consisting of the range from house load to 100% load at 246.05 KGSC supercritical once-through operation.

BOILER STARTUP PROCESS

More specifically, at the beginning of the warmup cycle, fuel is fired into the boiler 12 and controlled by the operator through a boiler control 21 (FIG. 1). Feedwater flow remains at 15% until the furnace pass outlet temperature reaches 232.22°C, at which time feedwater flow is gradually and automatically ramped from 15% to 25%. During this ramp time, fuel flow is automatically boosted to prevent a sag in fluid temperature otherwise resulting from increased water flow.

During the pressure ramp mode, pressure is controlled by the firing rate as in a conventional boiler. In the once-through cycle, pressure is basically the ratio between the fluid out of the process (steam) and the water into the process (feedwater). Therefore, if the pressure tends to sag, pressure controls index up the water flow to increase pressure as well as the fuel flow to maintain temperature.

As the water continues to heat, separator pressure increases. At approximately 35.15 KGSC there is adequate pressure to roll and synchronize the turbine 14 to 3% load. Fluid is then being removed from the separator 16 in two forms, i.e. as water through the P/P*b* valves 23 and as steam through the turbine. Therefore, to maintain the same level within the separator 16 as steam flow increases, the P/P*b* valves 23 close to reduce the water drainage flow. Firing continues until approximately 70.3 KGSC is achieved at 7% load.

The power plant is ready for the pressure ramp at this point. The purpose of the ramp is to allow a smooth and orderly transition from separator steam pressure operation to supercritical once-through operation.

Waterwall pressure is automatically controlled during the ramp by three sets of valves, i.e. the PPR valves, the W valves, and the Y valves. In this specific plant, there are four PPR valves 23 which are relatively small fine vernier pressure control valves. The W valves are larger pressure control valves and the two Y valves provide coarse pressure control.

Initially, waterwall pressure is controlled by the fine vernier PPR valves 23. One of the valves 23 is automatically forced open prior to startup with pressure at approximately 140.6 KGSC. As the density of the water decreases due to warmup and the water flow increases from 15 to 25%, the waterwall pressure starts to rise. When the pressure increases to 246.05 KGSC the second PPR Valve 23 is opened. To prevent cycling, a deadband is provided to prevent the valve from closing unless the pressure drops to 210.9 KGSC. Continued boiler firing causes the pressure again to reach 246.05 KGSC and the third valve 23 opens. This process continues until all four PPR valves 23 are opened. The PPR valves 23 are then no longer capable of providing automatic control.

Continued increase in waterwall pressure sequences the W valves open. These valves regulate pressure at 249.57 KGSC, which is 3.52 KGSC higher than the setpoint for the PPR valves 23 to assure proper sequential operation. When both W valves reach a total position greater than 80% and therefore are about out of range, the larger Y valves are pulsed open. The Y valve opening action results in a drop in pressure to cause the W valves to close partially. Continued pressure buildup again causes the W valves to move again in the open direction. When the W valves reach a combined total position of 80%, the Y valves are again pulsed open. This process continues, and when full pressure operation is achieved the two W valves and the two Y valves are 100% open.

A load demand computer 25 (FIG. 3) gradually ramps the pressure and load from 70.3 KGSC-7% load to 246.05 KGSC-25% load. During the ramp, the turbine valve manual/automatic station remains at 25% and the boiler master fuel demand increases the demand for fuel. This increases the firing rate which, in turn, increases steam pressure and generated megawatts. Steam pressure is controlled by the steam pressure control system, and the pressure setpoint is continually updated by the load demand computer 25.

DRAIN FLOW CONTROL

As steam pressure continues to rise, more and more fluid from the steam separator 16 leaves as steam through the turbine 14. This tends to cause a drop in separator level which is counteracted by the closure of the P/P*b* valves 23 by a flow control 41 as the pressure ramp progresses. At the top of the pressure ramp, the P/P*b* valves 23 are totally closed by the control 41, at which time the boiler 12 is operating as a once-through supercritical boiler.

The P/P*b* valves 23 are controlled throughout the pressure ramp to maintain separator level until a pressure of approximately 210.9 KGSC is reached. At this point, the fluid within the separator 16 is approaching the supercritical point and the level measurements become invalid. This could normally cause premature closing of the P/P*b* valves 23 which would force the system to become a once-through boiler instantly rather than allowing the continuation of a smooth ramp. To avoid this occurrence during the boiler transition, the control for the P/P*b* valves 23 is transferred from level regulation to pressure regulation.

The ramping process continues until the load demand computer 25 indicates a 25% load point. The separator 16 is then filled with supercritical fluid, the P/P*b* valves 23 are closed, and all waterwall pressure control valves are opened and the power plant is at 246.05 KGSC, 25% load. Several different controls act coordinatively on the P/P*b* valves 23. During warmup, separator level is controlled by the P/P*b* valves 23. The P/P*b* valves 23 are drain valves for the separator 16, and an excessive separator level opens them. During initial warmup and ramp phases, 25% water is pumped into the separator 16 and 25% water leaves through the P/P*b* valves 23. As turbine load increases, less fluid flows through the P/P*b* valves and more fluid flows through the turbine as steam until at full pressure the P/P*b* valves 23 are closed.

During initial warmup and pressure ramping, the P/P*b* valves 23 control separator level and toward the end of the ramp they maintain pressure. During normal full pressure operation, the P/P*b* valves 23 function as power operated overpressure control valves if the desired throttle pressure is exceeded. Thus, under abnormal conditions, the P/P*b* valves 23 are capable of quickly opening to a maximum position of 70% to lower throttle pressure back to the normal value.

At loads less than 25% with full pressure, the feedwater flow is restricted to a minimum of 25%. Therefore, for loads less than 25% the difference between the 25% water and the steam flow is drained through the P/P*b* valves 23 to the condenser 26. The P/P*b* valves 23 are characterized to drain the excess water.

PPR SEQUENCING CONTROL

Figure 4:
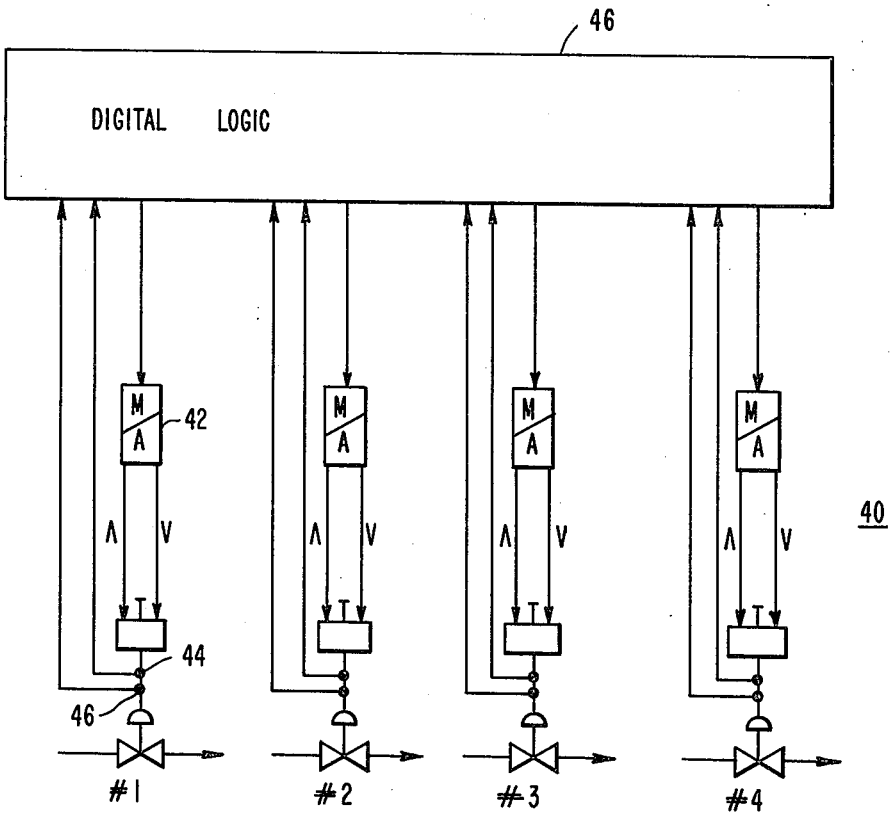
FIG. 4 and FIG. 5A–5B show functional block diagrams of valve sequencing controls arranged in accordance with the invention.

As shown in FIG. 4, the boiler control 21 includes a PPR valve sequencing control 40. It includes a manual-/automatic (M/A) station 42 for each PPR valve and an open limit switch and a closed limit switch for each PPR valve as indicated by the reference characters 44 and 46. A logic sequencing system 46 operates in the automatic mode through the M/A stations 42 to operate the PPR valves.

Figure 5A:
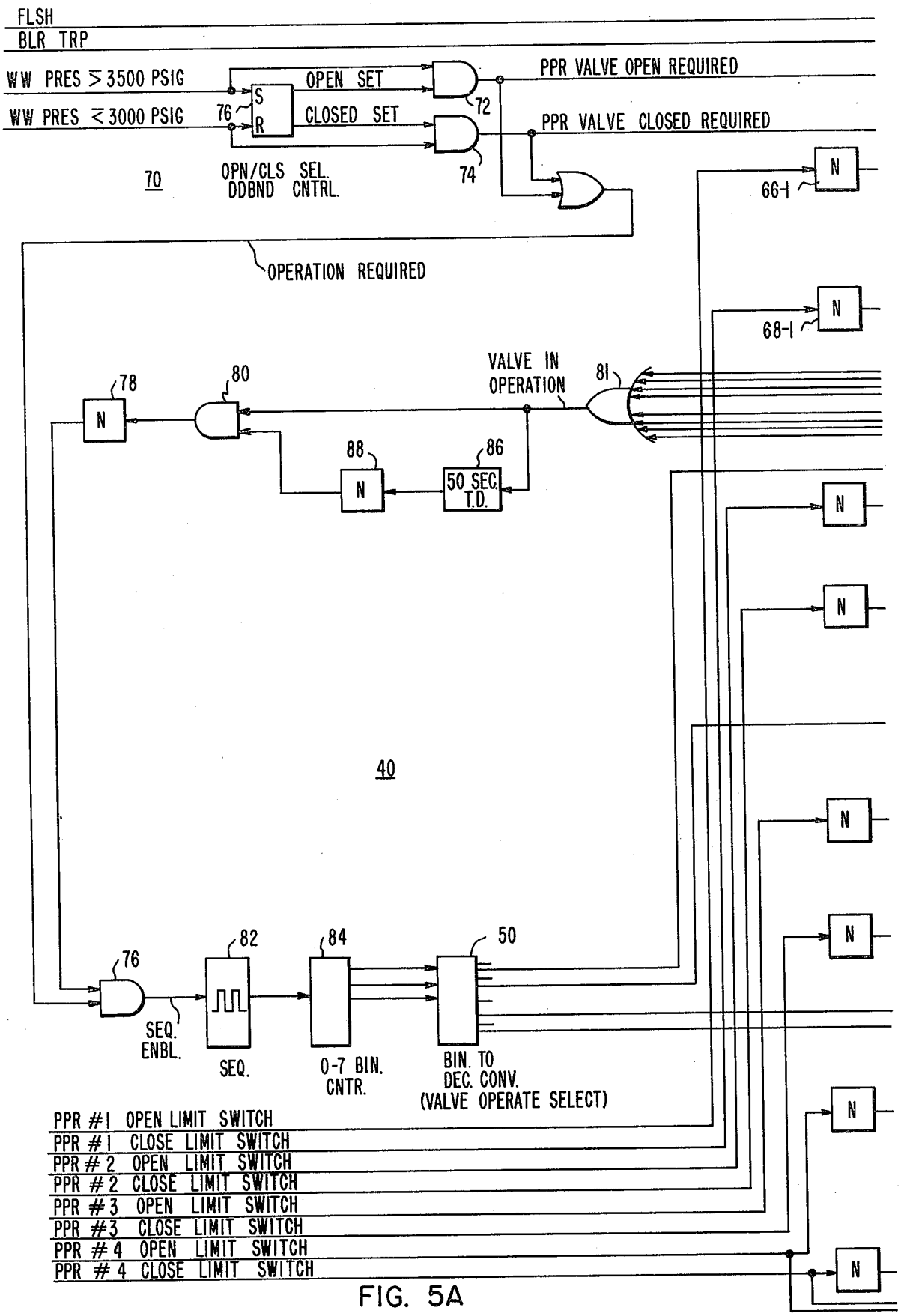
Figure 5B:
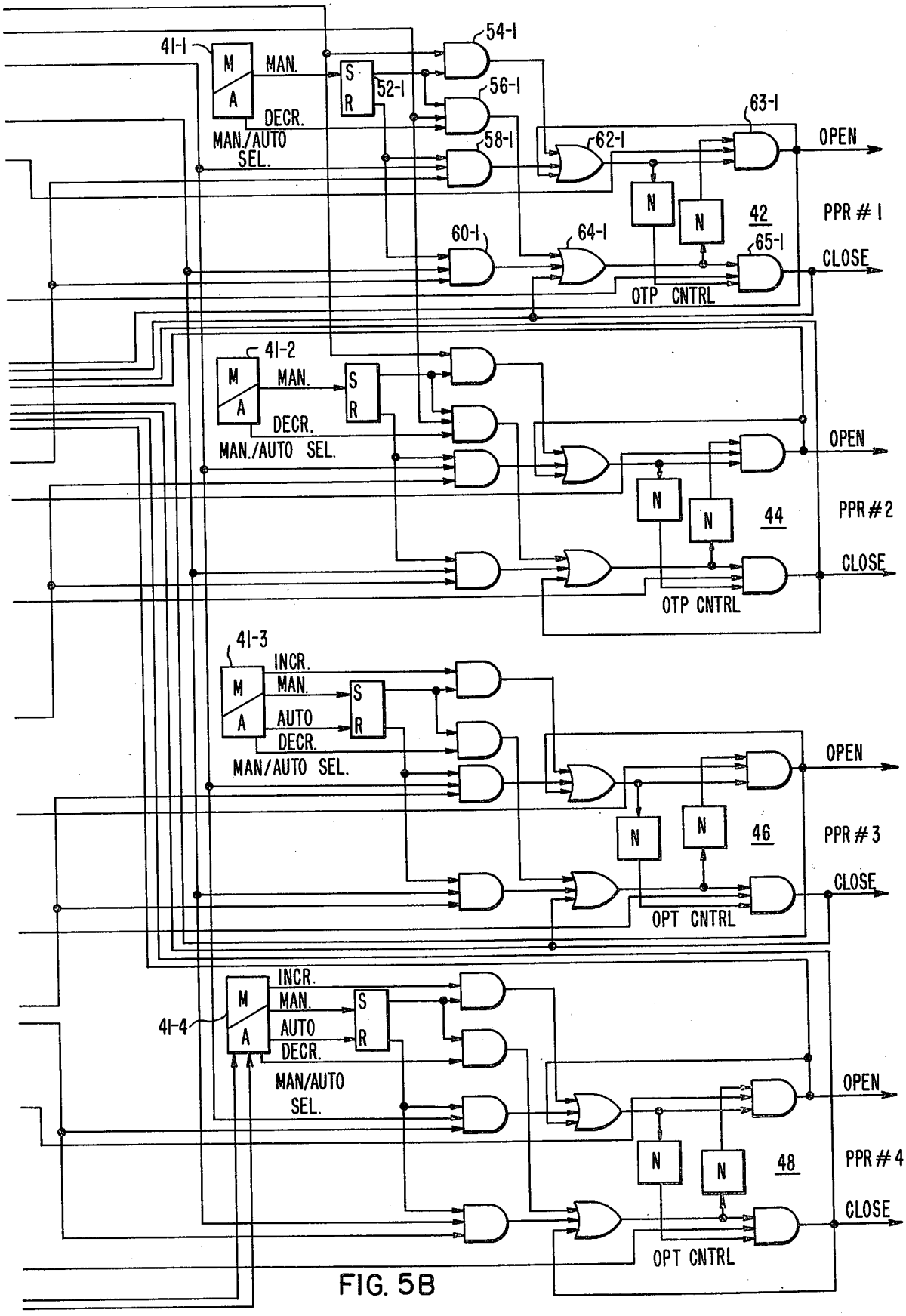

A functional block diagram is shown for the PPR sequencing control 40 in FIG. 5A–5B. Output control circuits 42, 44, 46 and 48 drive the valves in response to manual increase/decrease signals or to automatic open/close signals from a valve selector 50 according to the states of the M/A stations 41. An M/A flip-flop 52 controls the status of manual open and close AND gates 54 and 56 and the status of automatic open and close AND gates 58 and 60 to determine which ones actuate open and close OR circuits 62 and 64 to drive an OPEN AND circuit 63 or a CLOSE AND circuit 65 in the output valve control 42.

The open and close limit switches 44 and 46 function directly through NOT circuits 66 and 68 and the OR circuits 62 and 64 to defeat further attempted valve movement when a valve limit position is reached. The limit switch signals thus function as sequencer select permissives.

The PPR valves are all controlled to open or close in response to a single pressure control 70. Thus, when a suitable waterwall pressure sensor generates a signal indicating a pressure equal to or greater than 246.05 KGSC, a pressure demand AND block 72 enables the open AND gates for all of the PPR valves. When the waterwall pressure is equal to or less than 210.9 KGSC, a pressure demand AND block 74 enables the close AND gates for all of the PPR valves. A flip-flop 76 provides an adjustable deadband in the operation of the pressure demand AND blocks 72 and 74.

The sequencer selector 50 determines the sequence in which valves open or close in response to a pressure demand enabling signal. Thus, a sequence enabling signal is generated by AND block 76 if an open or close pressure demand enabling signal exists and normally if no valve is in its operation range, i.e. normally if all PPR valves are at limit positions as indicated by NOT block 78 and AND block 80 to which feedback signals are applied through OR block 81 from the output driver AND circuits 63 and 65.

A sequence enable signal triggers a conventional sequencer clock 82 which generates pulses to advance a binary counter 84. Generally, the clock generates pulses when a pressure demand exists and no valve is operating and stops pulsing when a valve is oerating. In turn, the sequence selector 50 is advanced by the counter 84 to generate a valve select signal from the next terminal after the terminal from which it had last generated a valve select signal. If the next terminal has no connection (such as terminal 2 as shown), the count simply advances to cause a valve select signal to be generated quickly from the following terminal.

The valve sequence select signal is applied to the open and close AND gates 58 and 60 for the selected valve. The pressure demand signal determines whether the open AND gate 58 or the close AND gate 60 initiates opening or closing movement of the selected valve.

A time delay circuit 86 allows an adjustable time period to occur after a valve selection, and it then generates an output disabling the valve-in-operation AND circuit 80 through a NOT circuit 88. A sequence enable signal is then generated if pressure demand exists, thereby enabling the sequencer to activate the next valve in the sequence and automatically avoid system hangups due to excessive valve operating time which might be due to a valve failure. In this case, the time delay period is set at 50 seconds to allow ample time for full movement of a PPR valve before the expiration of the delay period under the pressure demand existing during the boiler startup ramp.

To accommodate the logic control 40 for a plant in which a different number of PPR valves is emloyed, hardwire connections are made from the required number of terminals on the selector 50 to respective output control circuits for the respective valves. Feedback connections from the output control circuits are simply OR'ed together at the OR block 81, and the pressure demand signals from the central pressure control AND blocks 72 and 74 are bussed to each output control circuit. Thus, the startup system is provided with a valve sequencing control which is readily modified to accommodate varying numbers of valves and which performs needed valve sequencing control reliably and adaptively during boiler startup.

What is claimed is:

1. A startup system for a once-through boiler having a boiler feed pump for controllably driving water as a working fluid through the boiler where heat is added to the working fluid under burner control, said system comprising separator means disposed in the main boiler flow path, a plurality of valves connected in the main flow path upstream from said separator means, means for generating a demand signal representative of the difference between a predetermined boiler process pressure and a predetermined pressure setpoint, and means for controlling the operation of said valves in a predetermined opening or closing sequence in response to the pressure signal, said controlling means including respective means for driving each valve in opening or closing movement in response to the demand signal and a valve select signal, means for generating a plurality of signals indicating whether each of the respective valves is operating, and sequencer means for generating respective valve select signals for the respective valves in the predetermined sequence, said sequencer means advancing the sequence of the valve select signals to operate the next valve in the sequence when pressure demand exists and no valve is operating.

2. A system as set forth in claim 1, wherein said valves include at least one set of higher pressure regulating valves and a plurality of lower pressure regulating valves and said controlling means operates the lower pressure regulating valves.

3. A system as set forth in claim 1, wherein the lower pressure valves provided pressure regulation substantially up to the transition of the boiler into a super-critical state.

4. A system as set forth in claim 1, wherein means are provided for generating a signal representative of no valve in operation if the valve in operation has been in closing or opening operation for a predetermined time period and has not reached a limit position.

5. a system as set forth in claim 1, wherein said sequencer means includes a sequencer clock and a counter which is advanced by said clock to sequence the valve select signals, and logic circuit means for switching said clock to an on state when pressure demand exists and no valve is operating.

6. A startup control for a once-through boiler having a boiler feed pump for controllably driving water as a working fluid through the boiler where heat is added to the working fluid through the boiler where heat is added to the working fluid under burner control and further having separator means in the main boiler flow path with a plurality of pressure control valves connected upstream therefrom, said control comprising means for generating a demand signal representative of the difference between a predetermined boiler process pressure and a predetermined process setpoint, means for controlling the operation of said valves in a predetermined opening or closing sequence in response to the pressure signal, said controlling means including respective means for driving each valve in opening or closing movement in response to the demand signal and a valve select signal, means for generating a plurality of signals indicating whether each of the respective valves is operating, and sequencer means for generating respective valve select signals for the respective valves in the predetermined sequence, said sequencer means advancing the sequence of the valve select signals to operate the next valve in the sequence when pressure demand exists and no valve is operating.

7. A control as set forth in claim 6, wherein means are provided for generating a signal representative of no valve in operation if the valve in operation has been in closing or opening operation for a predetermined time period and has not reached a limit position.

8. A control as set forth in claim 6, wherein said sequencer means includes a sequencer clock and a counter which is advanced by said clock to sequence the valve select signals, and logic circuit means for switching said clock to an on state when pressure demand exists and no valve is operating.

9. A control as set forth in claim 6, wherein each of said driving means includes an AND valve close driver and an AND valve open driver, said pressure demand signal generating means including means for generating a valve close demand signal if the boiler pressure is below a first setpoint and a valve open demand signal if the boiler pressure is below a second and higher setpoint, and logic circuit means responsive to the valve open or close demand signal and the valve select signals to operate the AND open or close driver of the valve corresponding to the valve seletion signal.

10. A control as set forth in claim 9, wherein said valve operating signal generating means includes an OR circuit to which the output of each of said AND valve and AND valve close drivers is coupled.

* * * * *